US010640341B2

(12) United States Patent
Maedo

(10) Patent No.: US 10,640,341 B2
(45) Date of Patent: May 5, 2020

(54) METHOD FOR RAISING RAISABLE AND LOWERABLE MEMBER, AND CRANE

(71) Applicant: KOBELCO CONSTRUCTION MACHINERY CO., LTD., Hiroshima-shi (JP)

(72) Inventor: Teppei Maedo, Hyogo (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 145 days.

(21) Appl. No.: 15/924,678

(22) Filed: Mar. 19, 2018

(65) Prior Publication Data

US 2018/0282136 A1 Oct. 4, 2018

(30) Foreign Application Priority Data

Mar. 30, 2017 (JP) ..... 2017-067692

(51) Int. Cl.
*B66C 23/82* (2006.01)
*B66C 23/68* (2006.01)

(52) U.S. Cl.
CPC ..... *B66C 23/82* (2013.01); *B66C 23/68* (2013.01)

(58) Field of Classification Search
CPC ..... B66C 23/00; B66C 23/06; B66C 23/34; B66C 23/42; B66C 23/62; B66C 23/64; B66C 23/68; B66C 23/70; B66C 23/702; B66C 23/82; B66C 25/00
USPC ..... 212/270
See application file for complete search history.

(56) References Cited

U.S. PATENT DOCUMENTS 5,427,256 A * 6/1995 Kleppe ..... B66C 23/62 212/175
5,484,069 A * 1/1996 Lanning ..... B66C 23/36 212/175
5,960,970 A * 10/1999 Walker ..... B66C 23/36 212/294
6,010,018 A * 1/2000 Pech ..... B66C 23/94 188/31
6,062,405 A * 5/2000 Pech ..... B66C 23/36 212/298
6,481,202 B1 * 11/2002 Zuehlke ..... B66C 23/36 212/299
2010/0176078 A1 7/2010 Conrad et al.
(Continued)

FOREIGN PATENT DOCUMENTS

JP 2010-538930 12/2010

*Primary Examiner* — Michael R Mansen
*Assistant Examiner* — Juan J Campos, Jr.
(74) *Attorney, Agent, or Firm* — Oblon, McClelland, Maier & Neustadt, L.L.P.

(57) ABSTRACT

A rope routing step and a raising step are executed. In the rope routing step, in a state where a raisable and lowerable member and a boom are laid down, a raising rope is coupled to the raisable and lowerable member and routed to extend rearward of the raisable and lowerable member. In the raising step, the raising rope is wound up rearward to raise the raisable and lowerable member. In the rope routing step, the raising rope is routed to pass between a lower restriction section and an upper restriction section of a rope support member, and in the raising step, the raising rope is wound up rearward with a vertical movement of the raising rope restricted by the upper restriction section and the lower restriction section.

4 Claims, 13 Drawing Sheets

(56) References Cited

U.S. PATENT DOCUMENTS

| | | | | |
|---|---|---|---|---|
| 2010/0243595 | A1* | 9/2010 | Walker | B66C 23/26 212/294 |
| 2010/0252522 | A1 | 10/2010 | Conrad et al. | |
| 2014/0231374 | A1* | 8/2014 | Foust | B66C 23/70 212/347 |

* cited by examiner

METHOD FOR RAISING RAISABLE AND LOWERABLE MEMBER, AND CRANE

TECHNICAL FIELD

The present invention relates to a method for raising a raisable and lowerable member of a crane, and a crane.

BACKGROUND ART

Conventionally, there has been known a crane equipped with a machine body, a boom that is mounted to the machine body in a raisable and lowerable manner, and a raisable and lowerable member that can be raised and lowered with respect to the boom.

Such a crane may sometimes be assembled in a workplace where a work for suspending a load is performed. Specifically, the raisable and lowerable member and the boom which are laid down are raised. Thus, the crane becomes ready to suspend a load.

For example, Japanese Unexamined Patent Publication No. 2010-538930 discloses a method for raising a strut of a crane, the strut being mounted to a boom in a raisable and lowerable manner With this method, the strut is laid down, and with this state, a supporting post extending upward from the upper surface of the strut is attached to the strut. Next, a rope is connected to the supporting post. Then, the rope is wound up to the boom side, whereby the strut is raised.

However, with the method disclosed in Japanese Unexamined Patent Publication No. 2010-538930, that is, the method for raising the strut (raisable and lowerable member) by winding up the rope connected to the strut (raisable and lowerable member), if the raising amount of the raisable and lowerable member is small, the rope passes close to the upper surface of the boom. Therefore, an interference between the rope and the upper surface of the boom or various members mounted on the upper surface occurs, which is likely to damage the rope.

SUMMARY OF INVENTION

The present invention has been accomplished in view of the above-mentioned problems, and aims to provide a method for raising a raisable and lowerable member, and a crane, the method and crane make it possible to raise the raisable and lowerable member without causing damage to the rope.

In order to address the foregoing problems, the present invention provides a method for raising a raisable and lowerable member of a crane equipped with a machine body, a boom mounted to the machine body in a raisable and lowerable manner, and the raisable and lowerable member being raisable and lowerable with respect to the boom, the method comprising: a rope routing step of, in a state where the raisable and lowerable member and the boom are laid down along an installation surface on which the crane is placed, the boom extending forward of the machine body in a front-rear direction of the boom, the raisable and lowerable member extending forward of the boom in the front-rear direction of the boom, coupling a raising rope to the raisable and lowerable member and routing the raising rope to extend rearward of the raisable and lowerable member in the front-rear direction of the boom; and a raising step of winding up the raising rope rearward in the front-rear direction of the boom to raise the raisable and lowerable member with respect to the boom, the raising step being executed after the rope routing step. In the rope routing step, the raising rope is routed to pass between an upper restriction section and a lower restriction section of a rope support member attached to the boom, the lower restriction section being disposed at a position closer to the boom than the raising rope to support the raising rope at a position above an upper surface of the boom while allowing a movement of the raising rope in the front-rear direction of the boom, the upper restriction section being disposed at a position farther away from the boom than the raising rope to be contactable with the raising rope. In the raising step, the raising rope is wound up rearward in the front-rear direction of the boom with an upward movement of the raising rope restricted by the upper restriction section and a downward movement of the raising rope restricted by the lower restriction section.

The present invention also provides a method for raising a raisable and lowerable member of a crane equipped with a machine body, a boom mounted to the machine body in a raisable and lowerable manner, the raisable and lowerable member raisable and lowerable with respect to the boom, a support member that supports the boom and is raisable and lowerable with respect to the machine body, and a connection member for connecting a distal end of the boom and a distal end of the support member, the method comprising: a support member raising step of, in a state where the raisable and lowerable member and the boom are laid down along an installation surface on which the crane is placed with the raisable and lowerable member extending forward of the boom in a front-rear direction of the boom, raising the support member with respect to the machine body rearward of the boom in the front-rear direction of the boom such that the connection member obliquely extends forward and downward from the distal end of the support member toward the distal end of the boom; a rope routing step of coupling a raising rope to the raisable and lowerable member and routing the raising rope to extend rearward of the raisable and lowerable member in the front-rear direction of the boom; and a raising step of winding up the raising rope rearward in the front-rear direction of the boom to raise the raisable and lowerable member with respect to the boom, the raising step being executed after the support member raising step and the rope routing step. In in the rope routing step, the raising rope is routed to pass between an upper restriction section and a lower restriction section of a rope support member attached to the connection member, the lower restriction section being disposed at a position closer to the boom than the raising rope to support the raising rope at a position above an upper surface of the boom while allowing a movement of the raising rope in the front-rear direction of the boom, the upper restriction section being disposed at a position farther away from the boom than the raising rope to be contactable with the raising rope. In the raising step, the raising rope is wound up rearward in the front-rear direction of the boom with an upward movement of the raising rope restricted by the upper restriction section and a downward movement of the raising rope restricted by the lower restriction section.

The present invention also provides a crane comprising: a machine body; a boom mounted to the machine body in a raisable and lowerable manner; a raisable and lowerable member mounted in a raisable and lowerable manner with respect to the boom; and a rope support member that is attached to the boom to support a raising rope coupled to the raisable and lowerable member, wherein the rope support member includes a lower restriction section and an upper restriction section, the lower restriction section being disposed at a position closer to the boom than the raising rope to support the raising rope at a position above an upper surface of the boom while allowing a movement of the raising rope in a front-rear direction of the boom in a preparatory state where the raisable and lowerable member and the boom are laid down along an installation surface on which the crane is placed with the boom extending forward of the machine body in the front-rear direction of the boom and with the raisable and lowerable member extending forward of the boom in the front-rear direction of the boom, the upper restriction section being disposed at a position farther away from the boom than the raising rope to be contactable with the raising rope in the preparatory state.

The present invention provides a method for raising a raisable and lowerable member and a crane which can ensure raising a raisable and lowerable member without causing damage to a rope.

DESCRIPTION OF EMBODIMENTS

Figure 1:
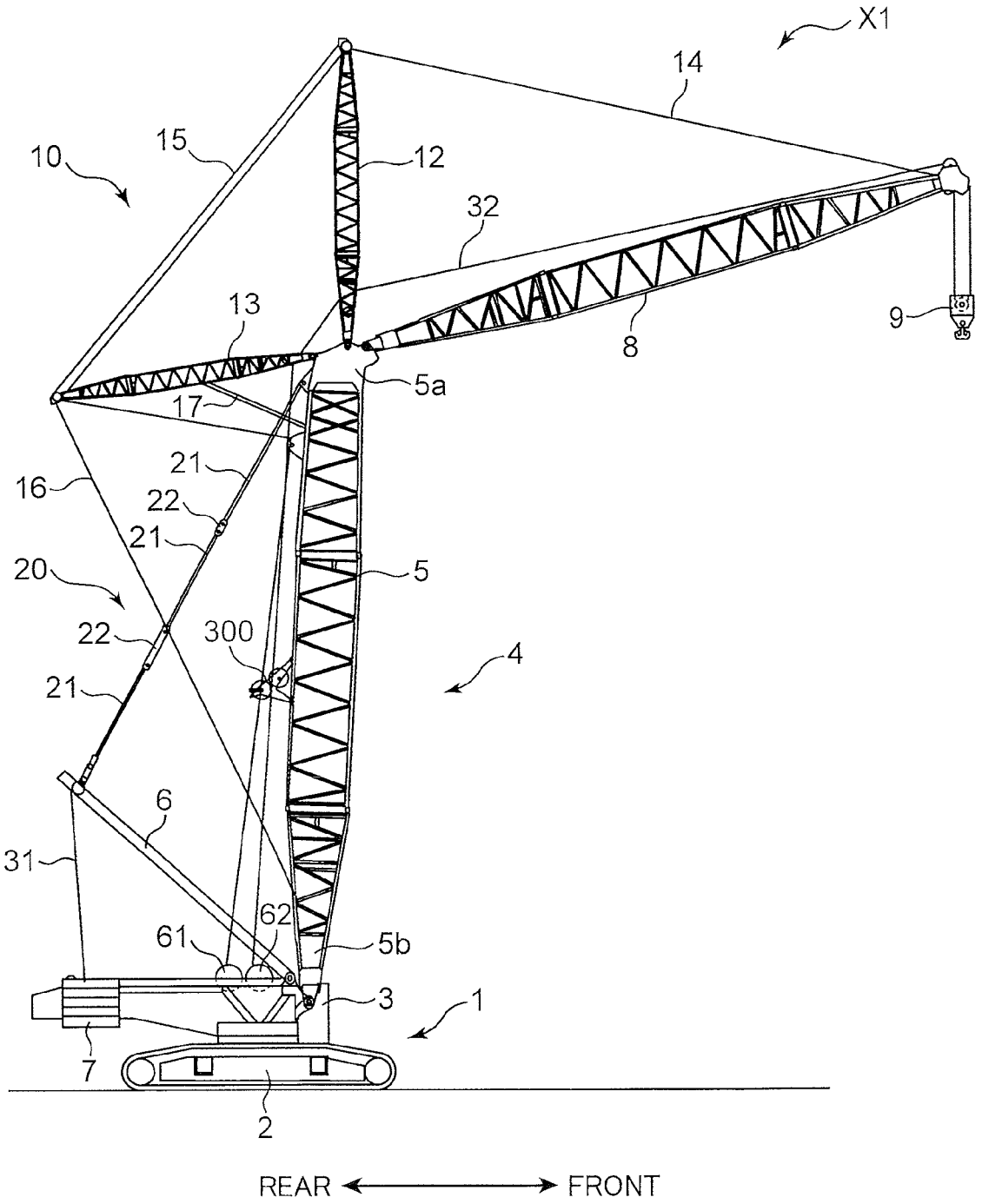
FIG. 1 is a side view illustrating a configuration of a crane according to a first embodiment.

One embodiment of the present invention will now be described below with reference to the drawings. Note that, for the sake of convenience of description, each drawing referred to below briefly illustrates only main components of a crane X1 according to the present embodiment. Therefore, it is possible that the crane X1 according to the present embodiment includes, as appropriate, any components or any steps not illustrated in the drawings referred to in the present specification.

(1) First Embodiment

(1-1) Overall Configuration of Crane

FIG. 1 illustrates the crane X1 according to the first embodiment of the present invention. FIG. 1 illustrates the assembled crane X1, that is, the crane X1 which is ready to perform a work for suspending a load.

Figure 2:
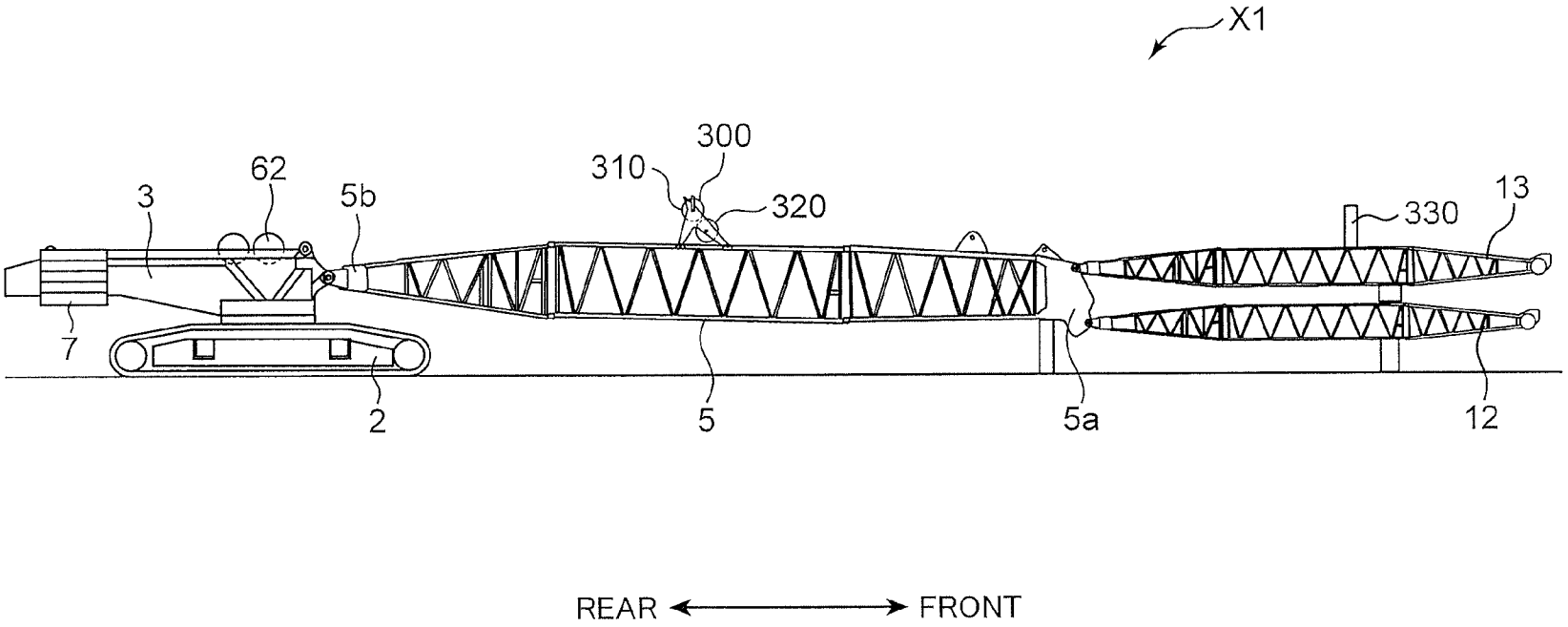
FIG. 2 is a side view of the crane to which a work for raising a rear strut has not yet been performed.

The crane X1 illustrated in FIG. 1 includes a machine body 1 having a lower travelling body 2 and an upper slewing body 3 mounted on the lower travelling body 2, and an attachment 4 attached to the upper slewing body 3. In the following description, the horizontal direction in FIG. 1 and the horizontal direction in FIG. 2 are defined as a front-rear direction. The horizontal direction in FIG. 2 corresponds to the longitudinal direction of a boom 5 described later and the front-rear direction of the boom 5 in a state where the boom 5 is laid down along an installation surface on which the crane X1 is placed.

The lower travelling body 2 of the machine body 1 is configured to be capable of traveling on a ground, and has a pair of crawlers, for example. The upper slewing body 3 of the machine body 1 is configured to be slewable about an axis extending in a direction perpendicular to a travel surface (that is, the installation surface on which the crane X1 is placed) on which the lower travelling body 2 travels.

A main winch 62 for winding up and out a wire rope and a jib raising-lowering winch 61 are mounted on the upper slewing body 3. It is to be noted that these winches 61 and 62 may be mounted on the boom 5 described later.

The attachment 4 is provided for a work for hoisting a load and a work for suspending a load.

The attachment 4 includes the boom 5, a mast (support member) 6 connected to the boom 5, a counterweight 7 mounted on the upper slewing body 3, a jib 8 raisable and lowerable with respect to the boom 5, a hook 9 for carrying a load, a strut unit 10, and a main guy line (connection member) 20.

The boom 5 has a base end 5*b* mounted to the upper slewing body 3 to be pivotable, and a distal end 5*a* opposite to the base end 5*b*. The main guy line 20 is a member for connecting the distal end 5*a* of the boom 5 (that is, the tip of the boom 5) and the tip of the mast 6 mounted to the upper slewing body 3. The boom 5 is supported by the mast 6 through the main guy line 20.

The tip of the mast 6 is connected to the counterweight 7 through a wire rope 31. When the wire rope 31 connecting the mast 6 and the counterweight 7 is wound up by a mast winch, the inclination angle of the mast 6 relative to the ground is changed. Thus, the boom 5 connected to the mast 6 is raised and lowered.

As described above, the main guy line 20 is a member for connecting the distal end 5*a* of the boom 5 and the tip of the mast 6. In the present embodiment, two main guy lines 20 and 20 are arranged in the width direction (the direction orthogonal to the sheet surface of FIG. 1, and this direction may be merely referred to as the width direction of the boom 5 in some cases) of the boom 5. Each main guy line 20 includes a plurality of (three in FIG. 1) boom guy links 21. Specifically, the plurality of boom guy links 21 is connected such that one end of one of the boom guy links 21 is connected to the end of the adjacent boom guy link 21 in the longitudinal direction, thereby forming one main guy line 20.

A rope support member 300 is mounted near the center (near the center in the vertical direction in FIG. 1) of the boom 5 in the longitudinal direction. The detailed structure of the rope support member 300 will be described later.

The jib 8 is mounted at the distal end 5*a* of the boom 5. The base end of the jib 8 is mounted to the distal end 5*a* of the boom 5 to be pivotable. Thus, the jib 8 is raisable and lowerable with respect to the boom 5 and the machine body 1.

The hook 9 is hung from the tip of the jib 8. A wire rope 32 connected to the main winch 62 is coupled to the hook 9. The hook 9 is hung from the tip of the jib 8 to be movable in the vertical direction by the wire rope 32 being wound up or out by the main winch 62.

The strut unit 10 supports the jib 8 at the back of the jib 8 to prevent the jib 8 from falling forward. The strut unit 10 has a front strut 12, a rear strut 13, a jib guy line 14, a jib raising-lowering wire rope 15, and a strut guy line 16.

The front strut 12 is mounted at the distal end 5*a* of the boom 5 in a raisable and lowerable manner with respect to the boom 5 and the machine body 1. The rear strut 13 is disposed behind the front strut 12. The rear strut 13 is mounted at the distal end 5*a* of the boom 5 in a raisable and lowerable manner with respect to the boom 5 and the machine body 1. The strut guy line 16 connects the tip of the rear strut 13 and a base end part of the boom 5. In the present embodiment, the jib 8 is supported by two struts, the front strut 12 and the rear strut 13. However, the jib 8 is not limited thereto, and may be supported by only one strut.

The jib guy line 14 connects the tip of the front strut 12 and the tip of the jib 8. The jib 8 is supported by the front strut 12.

The front strut 12 and the rear strut 13 are connected to each other by the jib raising-lowering wire rope 15. The jib raising-lowering wire rope 15 is connected to the jib raising-lowering winch 61. The jib raising-lowering winch 61 winds up and out the jib raising-lowering wire rope 15. Due to the jib raising-lowering wire rope 15 being wound up and out, the angle made by the front strut 12 and the rear strut 13 is changed. Thus, the jib 8 is raised and lowered with respect to the boom 5.

(1-2) Rope Support Member

In a place where a load is to be suspended, the boom 5, the jib 8, and the strut unit 10 which are laid down on the installation surface on which the crane X1 is placed are raised, and the crane X1 is assembled to be ready to suspend a suspended load (load) as illustrated in FIG. 1. The rope support member 300 is used for the raising process described above.

Figure 3:
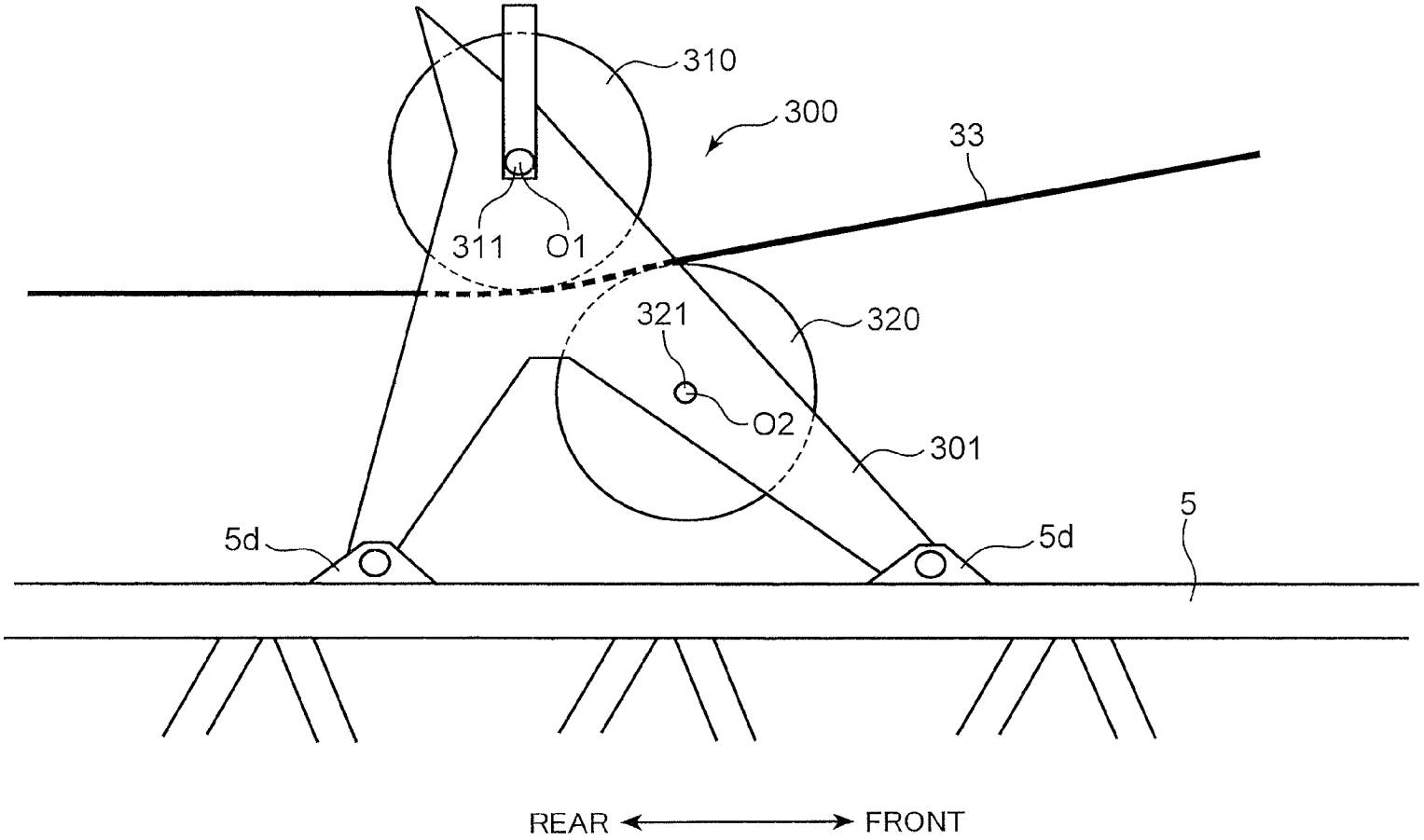
FIG. 3 is a side view illustrating, as enlarged, a part near a rope support member.
Figure 4:
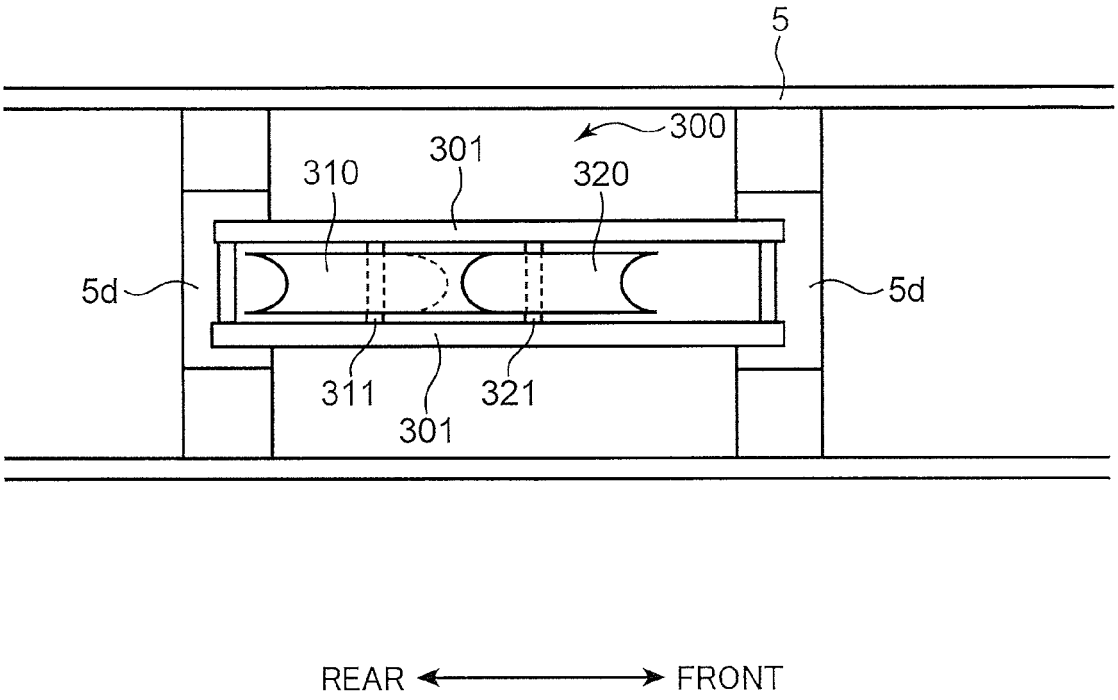
FIG. 4 is a top view corresponding to FIG. 2.

FIG. 2 is a view illustrating the crane X1 before the boom 5 and the strut unit 10 are raised. Before the raising process, the crane X1 is in a state (preparatory state) where the boom 5 and the strut unit 10 are laid down on the installation surface, such as a ground, so as to extend along the installation surface with the boom 5 extending forward of the machine body 1 and the strut unit 10 extending forward of the boom 5. In the present embodiment, the strut unit 10 is laid down in a position in which the rear strut 13 is located above the front strut 12 as illustrated in FIG. 2. Note that FIG. 2 does not illustrate the jib 8. In the following description of the rope support member 300, the vertical direction in FIG. 2 is merely referred to as a vertical direction. FIG. 3 is a side view illustrating, as enlarged, a part of FIG. 2 near the rope support member 300. FIG. 4 is a top view corresponding to FIG. 3.

In the state illustrated in FIG. 2, the rope support member 300 is located at almost the central part of the upper surface (the upper surface in FIG. 2) of the boom 5 in the front-rear direction to project upward from the upper surface. The rope support member 300 has a pair of support sections 301 and 301 attached to the upper surface of the boom 5, and two pulleys 310 and 320. The two pulleys 310 and 320 are configured of rotary body.

The support sections 301 and 301 have a plate shape and face each other in the width direction of the boom 5. The support sections 301 and 301 are attached to a pair of mounting sections 5*d* and 5*d* arranged in the front-rear direction on the upper surface of the boom 5. In the present embodiment, each support section 301 is bifurcated into a front part and a rear part on the lower part thereof. The front parts at the lower parts of the respective support sections 301 are attached to the front mounting section 5*d*. The rear parts at the lower parts of the respective support sections 301 are attached to the rear mounting section 5*d*. The respective support sections 301 and 301 extend upward from the upper surface of the boom 5. That is, the respective support sections 301 and 301 extend in the front-rear direction and in the vertical direction.

The two pulleys 310 and 320 are supported by the support sections 301 and 301 between the support sections 301 and 301. Specifically, the rope support member 300 has two shafts 311 and 321 extending between the two support sections 301 and 301. The two pulleys 310 and 320 are supported respectively by the shafts 311 and 321 to be rotatable about the shafts 311 and 321.

The two pulleys 310 and 320 are disposed to be shifted from each other in the vertical direction and in the front-rear direction. Specifically, the two pulleys 310 and 320 have almost the same diameter and same thickness (the size in the width direction of the boom 5). A rotation center O1 and an upper end position of the pulley 310 are above a rotation center O2 and an upper end position of the other pulley 320. Further, the rotation center O1 and a rear end position of the upper pulley 310 (hereinafter referred to as the upper sheave 310) are respectively posterior to the rotation center O2 and a rear end position of the lower pulley 320 (hereinafter referred to as the lower sheave 320).

The distances between the rotation center O1 of the upper sheave 310 and the rotation center O2 of the lower sheave 320 in the front-rear direction and the vertical direction are smaller than the diameter of the sheaves 310 and 320. Thus, the upper sheave 310 and the lower sheave 320 are disposed to be partially overlapped with each other in a top view and in a front view. In addition, the lower sheave 320 is disposed such that the lower end thereof is above the upper surface of the boom 5.

As described later, in a state where the raising rope 33 is routed between the upper sheave 310 and the lower sheave 320, the upper sheave 310 can be in contact with the raising rope 33 from above. As described above, the upper sheave 310 functions as an upper contact member that can be in contact with the raising rope 33 from above. In addition, as described later, in the state where the raising rope 33 is routed between the upper sheave 310 and the lower sheave 320, the lower sheave 320 can be in contact with the raising rope 33 from below. As described above, the lower sheave 320 functions as a lower contact member that can be in contact with the raising rope 33 from below.

It is to be noted that the support sections 301 and 301 may have any shapes that can support the upper sheave 310 and the lower sheave 320, and are not limited to have the shape described in the present embodiment. That is, the support sections 301 and 301 may not have a plate shape or a bifurcated shape.

(1-3) Procedure for Raising Raisable and Lowerable Member

Next, a procedure for raising the raisable and lowerable member that can be raised and lowered with respect to the machine body 1 and the boom 5 by using the rope support member 300 will be described. In the present embodiment, the procedure for raising the rear strut 13, which is one of components serving as the raisable and lowerable member, with respect to the boom 5 will be described. In the description of the procedure, the vertical direction in FIG. 2 is also merely referred to as a vertical direction.

(Preparatory Step)

First, the crane X1 is brought into the state illustrated in FIG. 2 (that is, in the state where the boom 5 and the strut unit 10 are laid down on the installation surface, such as a ground, so as to extend along the installation surface with the boom 5 extending forward of the machine body 1 and the strut unit 10 extending forward of the boom 5), as described above.

In addition, a raising bar 330 is attached on the upper surface of the rear strut 13 as illustrated in FIG. 2. The raising bar 330 has a shape extending in a predetermined direction. The raising bar 330 is attached to the rear strut 13 to project upward from the upper surface of the rear strut 13. In the present embodiment, the raising bar 330 is attached at almost the central part of the rear strut 13 in the front-rear direction. Note that the raising bar 330 may be formed integrally with the rear strut 13, and in such a case, the step of attaching the raising bar 330 to the rear strut 13 is skipped.

(Rope Routing Step)

Next, the raising rope 33 which is a wire rope for raising the rear strut 13 is coupled to the rear strut 13. In the present embodiment, the raising rope 33 is coupled to the rear strut 13 through the raising bar 330. In addition, the raising rope 33 is routed to extend rearward from the rear strut 13 through the upper sheave 310 and the lower sheave 320 of the rope support member 300.

Figure 5:
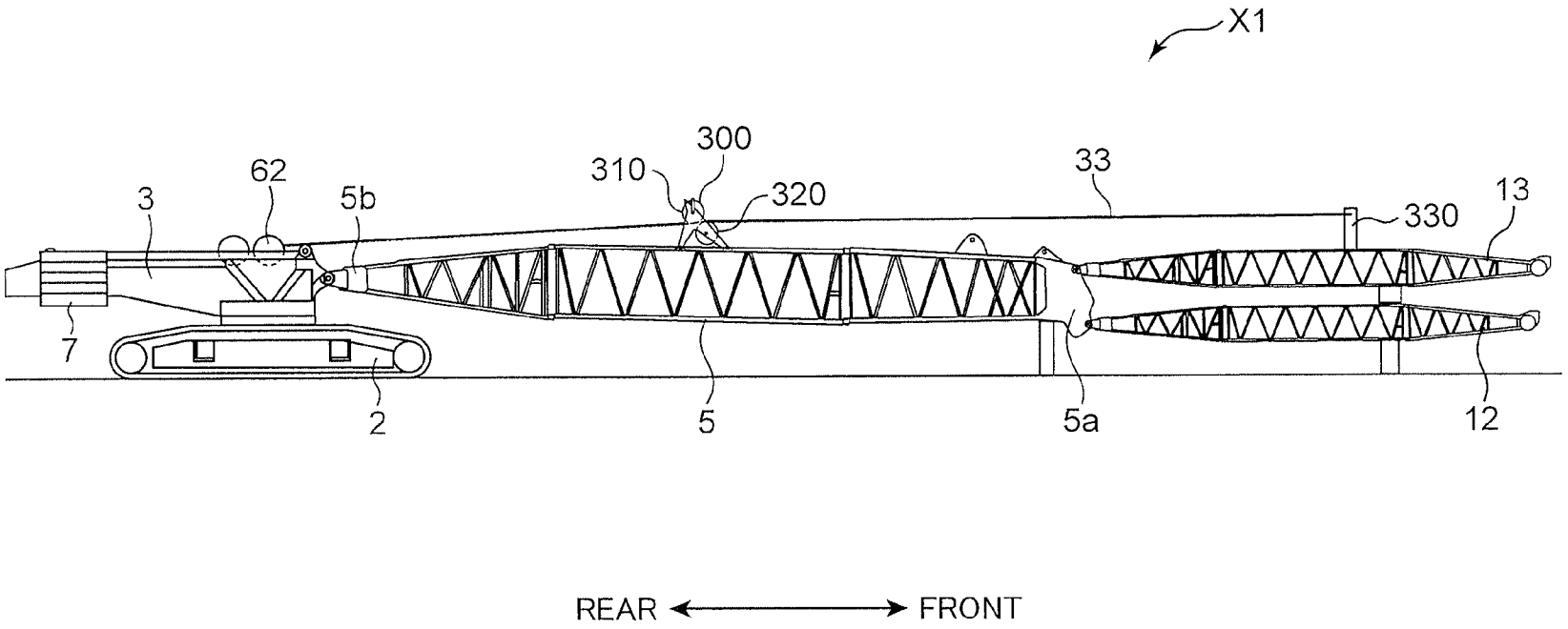
FIG. 5 is a side view of the crane after a rope routing step is ended.

Specifically, the raising rope 33 wound around the main winch 62 is pulled forward from the main winch 62. Then, as illustrated in FIG. 3, the raising rope 33 is pulled to the raising bar 330 while passing between the upper sheave 310 and the lower sheave 320 of the rope support member 300. Then, the end of the raising rope 33 is coupled to the raising bar 330. In the present embodiment, the raising rope 33 is coupled to the upper end of the raising bar 330. Thus, the raising rope 33 is routed to extend from the upper end of the raising bar 330 to the main winch 62 through between the upper sheave 310 and the lower sheave 320 of the rope support member 300, while being supported by the lower sheave 320, as illustrated in FIG. 5.

As described above, the upper sheave 310 and the lower sheave 320 are disposed to be overlapped with each other in a front view. Therefore, as illustrated in FIG. 3, the raising rope 33 is routed to be in contact with the outer peripheral surfaces of both sheaves 310 and 320.

In the present embodiment, the wire rope wound around the main winch 62 is used as the raising rope 33 as described above. However, the wire rope wound around the jib raising-lowering winch 61 may be used as the raising rope 33 instead. Alternatively, the raising rope 33 and the winch may be additionally prepared.

(Raising Step)

Next, the raising rope 33 is wound up rearward to raise the rear strut 13 with respect to the boom 5.

Specifically, the raising rope 33 is wound up by the main winch 62. Thus, the raising rope 33 moves rearward through between the upper sheave 310 and the lower sheave 320. In the present embodiment, the raising rope 33 is routed to be in contact with the upper sheave 310 and the lower sheave 320 of the rope support member 300 as described above. Thus, the raising rope 33 moves while rotating the upper sheave 310 and the lower sheave 320.

Figure 6:
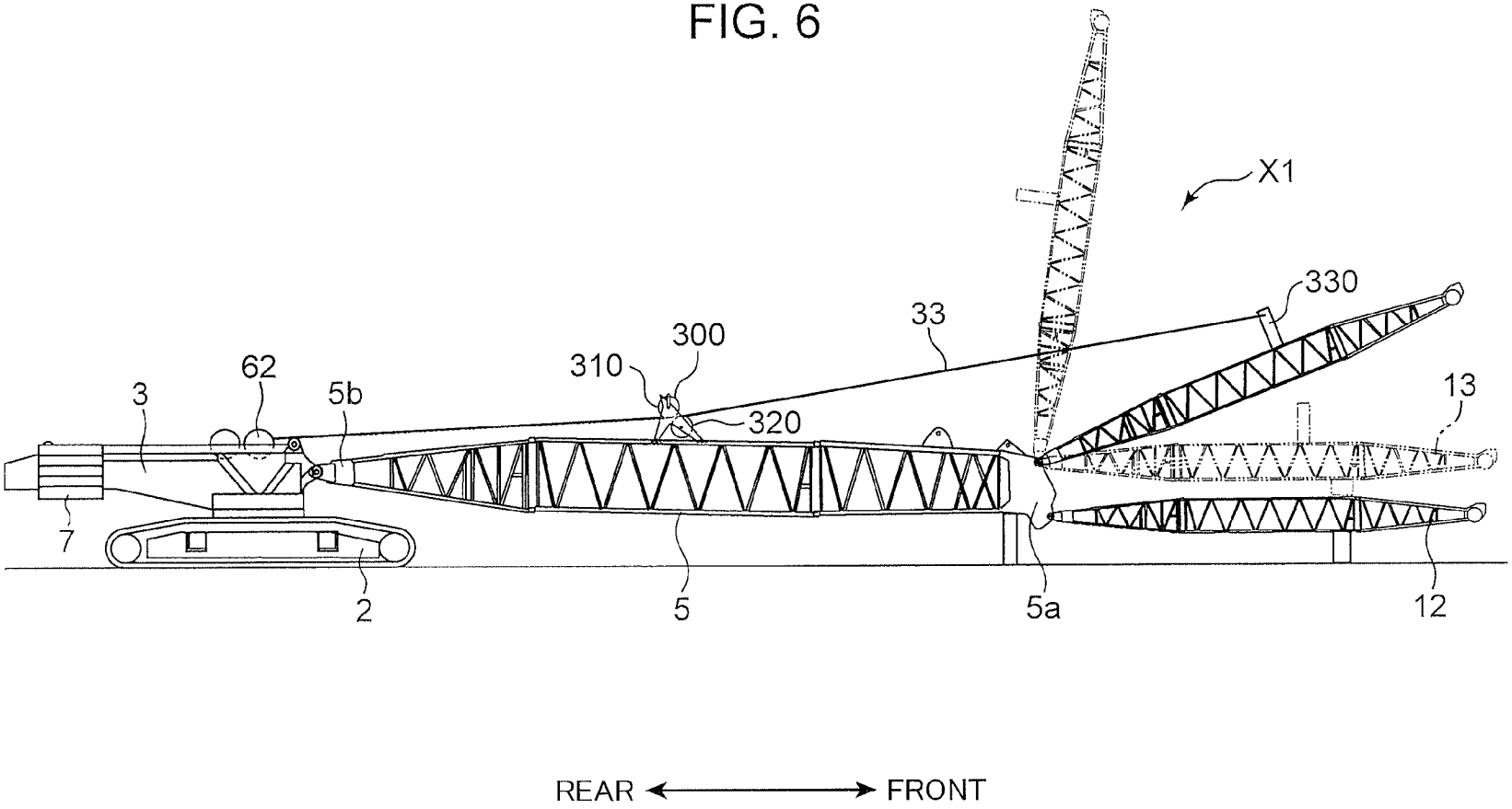
FIG. 6 is a side view of the crane to which a raising step is currently executed.

Due to the wind-up of the raising rope 33 described above, the rear strut 13 pivots about the joint portion between the rear strut 13 and the distal end 5*a* of the boom 5 from the position indicated by a broken line to the position indicated by a solid line in FIG. 6. In the present embodiment, the rear strut 13 is raised up to erect almost upright from the distal end 5*a* of the boom 5 as indicated by a chain line in FIG. 6.

(1-4) Operation and Others

As described above, in the present embodiment, the rear strut 13 is raised by winding up the raising rope 33 connected to the rear strut 13. Thus, it is unnecessary to prepare a crane or the like for hoisting the rear strut 13 for raising the rear strut 13. Accordingly, this configuration provides a cost advantage. Further, it is unnecessary to ensure a space for installing a hoisting crane. Accordingly, the rear strut 13 can be raised in less space.

Moreover, the raising rope 33 is wound up while being supported at a position above and distant from the upper surface of the boom 5 by the rope support member 300. Therefore, an interference between the raising rope 33 and the upper surface of the boom 5 or various members provided on the upper surface of the boom 5 can be prevented while winding up the raising rope 33. Accordingly, damage to the raising rope 33 caused by the interference can be suppressed.

Furthermore, the raising rope 33 moves through between the upper sheave 310 and the lower sheave 320 of the rope support member 300 while being wound up. Therefore, the vertical movement of the raising rope 33 is restricted by the sheaves 310 and 320, whereby a strong vertical swing of the raising rope 33 accompanied by the movement can be suppressed. Accordingly, the interference between the raising rope 33 and the other members caused by the vertical swing can also be suppressed, whereby damage to the raising rope 33 can more reliably be suppressed.

Particularly, in the present embodiment, the raising rope 33 moves while being in contact with the outer peripheral surfaces of both sheaves 310 and 320 as described above. Therefore, the vertical swing of the raising rope 33 can reliably be reduced.

Further, in the present embodiment, the upper sheave 310 and the lower sheave 320 are pulleys, and the raising rope 33 moves while rotating these sheaves. Therefore, the raising rope 33 can smoothly be moved.

In addition, in the present embodiment, the raising rope 33 is connected to the raising bar 330 projecting upward from the upper surface of the rear strut 13. Therefore, when the raising rope 33 is wound up, a high rotation moment can be applied to the rear strut 13. Accordingly, the rear strut 13 can efficiently be raised.

(2) Second Embodiment

Next, a crane X1 and a procedure for raising a raisable and lowerable member according to the second embodiment of the present invention will be described.

Figure 8:
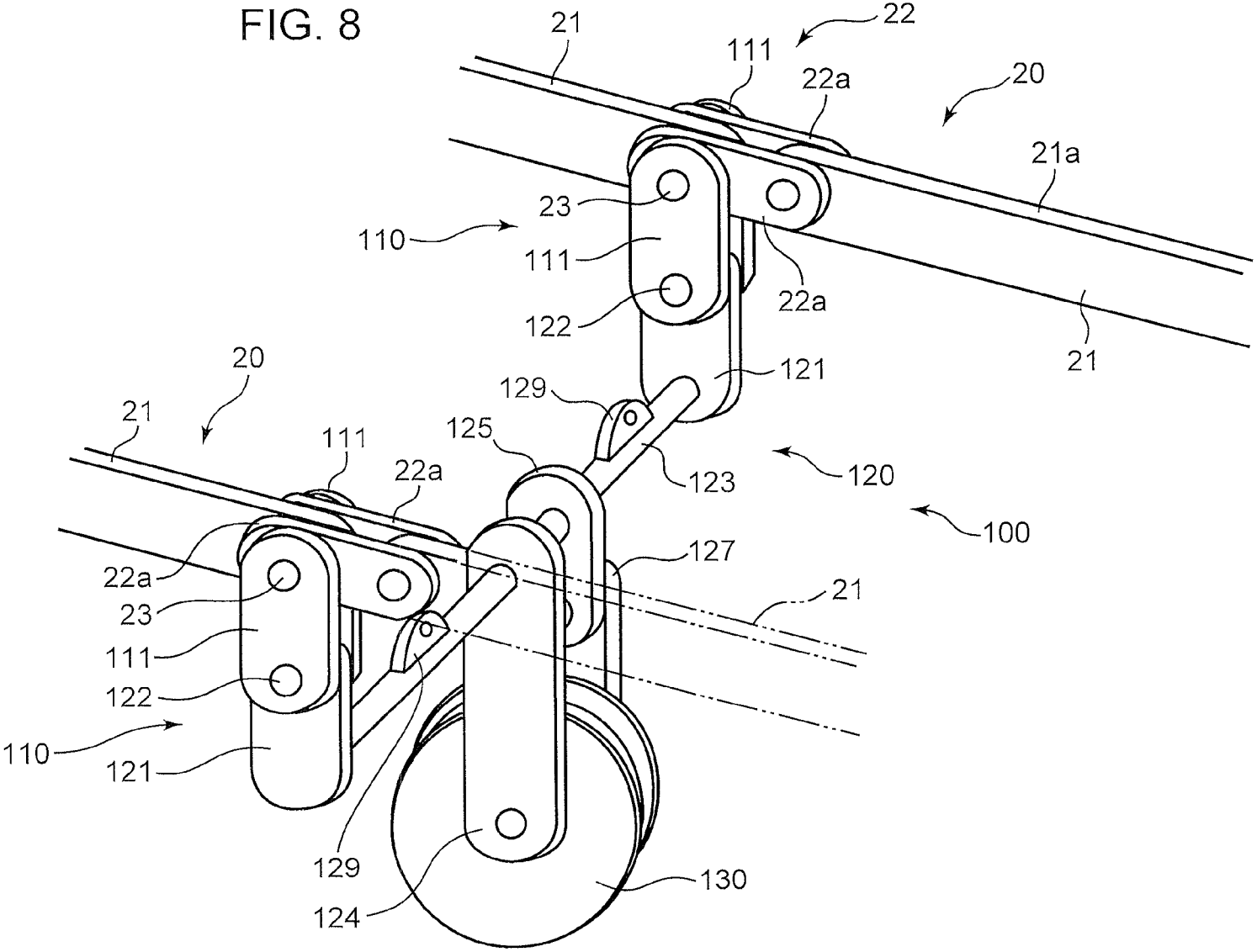
FIG. 8 is a perspective view of a guide member.
Figure 9:
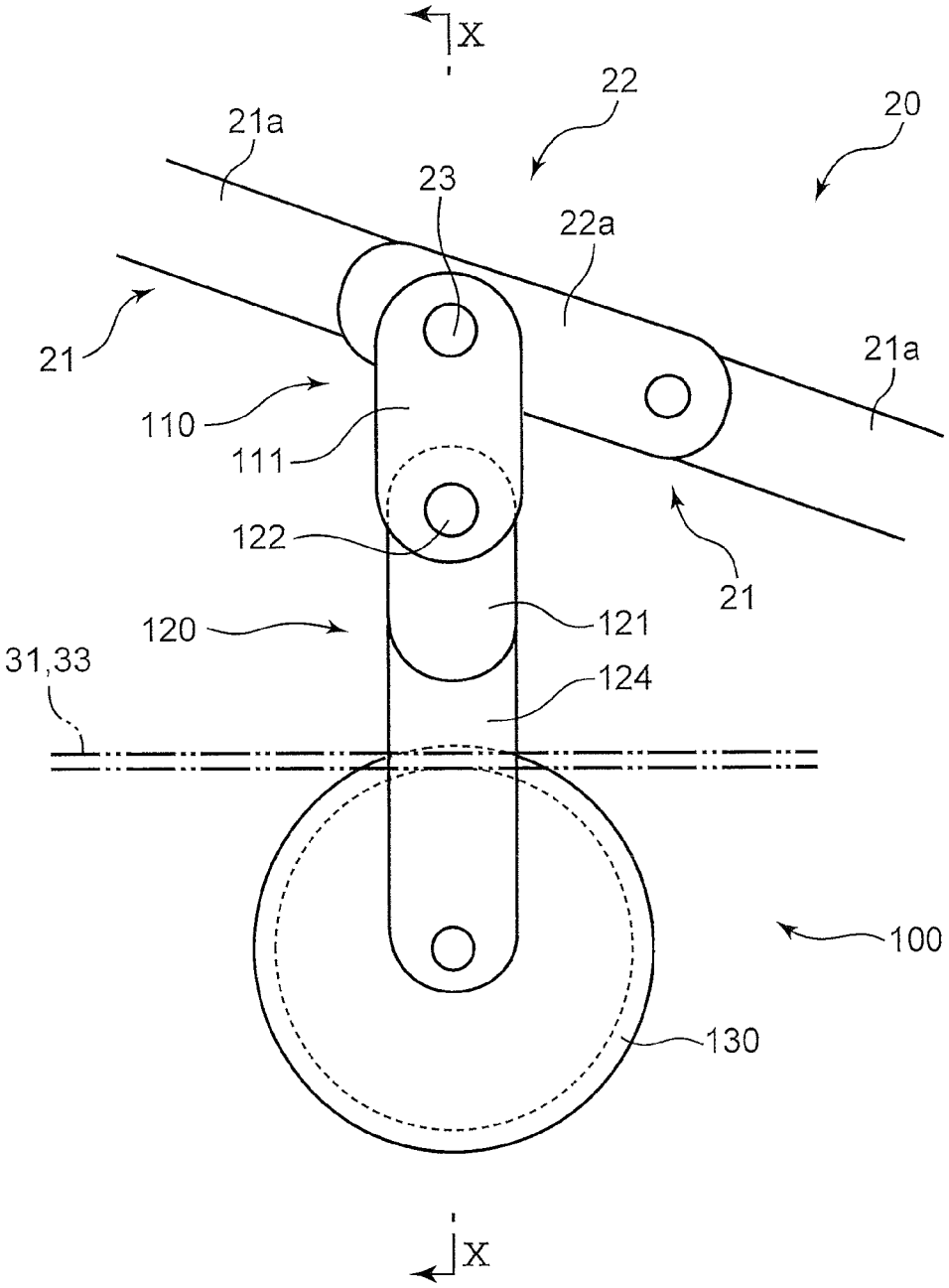
FIG. 9 is a side view of the guide member.
Figure 10:
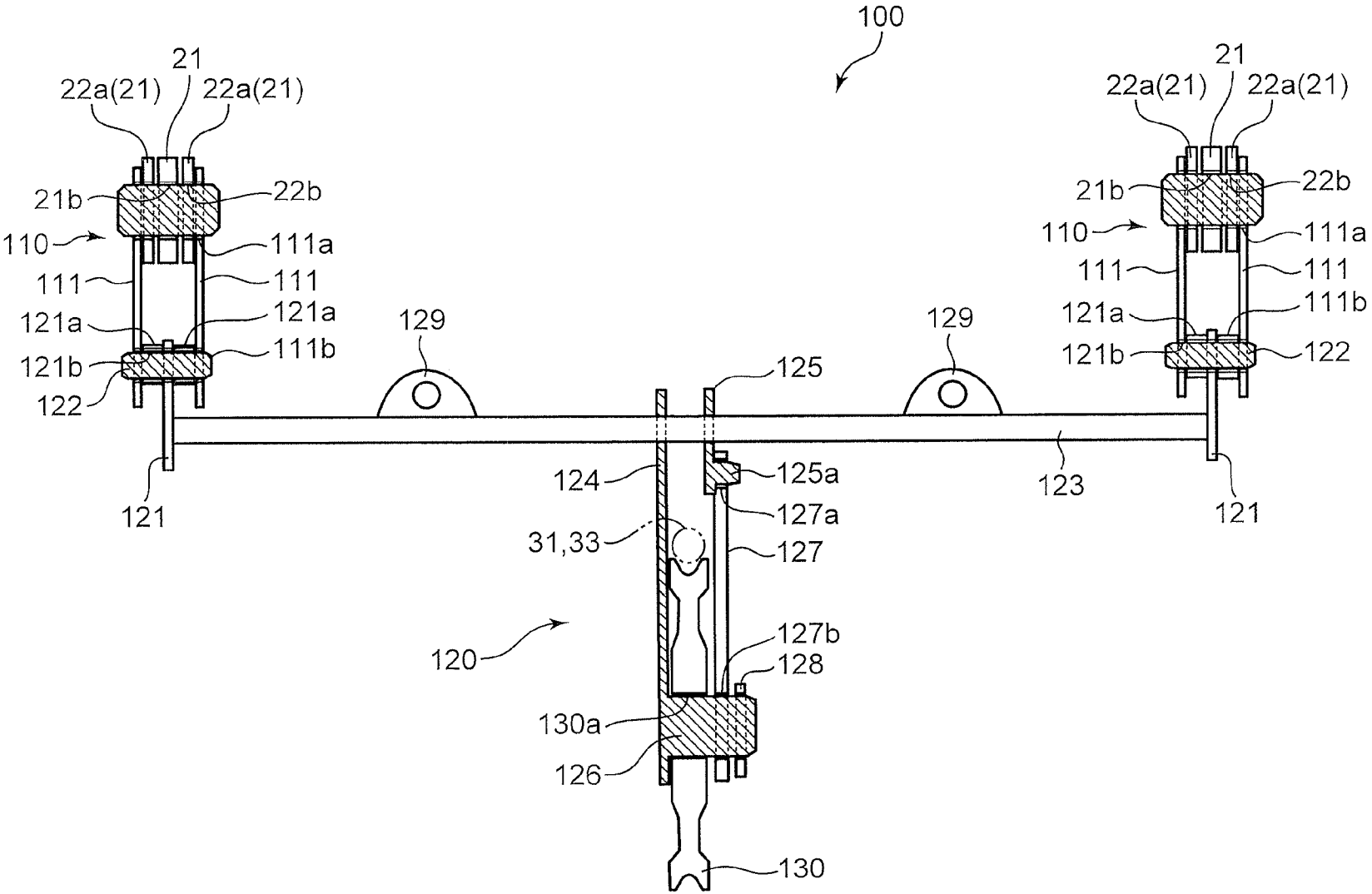
FIG. 10 is a sectional view along a line X-X in FIG. 9.

In the second embodiment, a rope support member 100 illustrated in FIGS. 8 to 10 is used instead of the rope support member 300 illustrated in FIG. 3 or other drawings. The configuration other than the rope support member is the same between the first embodiment and the second embodiment, and the description for the configuration other than the rope support member will be omitted below. The rope support member 100 according to the second embodiment is used by being attached to the main guy line 20. FIGS. 8 and 9 are each a schematic perspective view and a side view of the rope support member 100 attached to the main guy line 20. FIG. 10 is a sectional view along a line X-X in FIG. 9. Note that a portion of a hatched line indicating a cross section is not illustrated in FIG. 10 for clarification. In the following description, the rope support member 100 according to the second embodiment is referred to as a guide member 100.

(2-1) Structure of Main Guy Line

The structure of the main guy line 20 to which the guide member 100 is attached will be described.

In the present embodiment, two main guy lines 20 and 20 are arranged in the width direction (the direction orthogonal to the sheet surface of FIG. 1, and this direction may be merely referred to as the width direction of the boom 5 in some cases) of the boom 5. Each main guy line 20 includes a plurality of (three in FIG. 1) boom guy links (unit connection members) 21. Specifically, the plurality of boom guy links 21 is connected such that one end of one of the boom guy links 21 is connected to the end of the adjacent boom guy link 21 in the longitudinal direction, thereby forming one main guy line 20.

Figure 7:
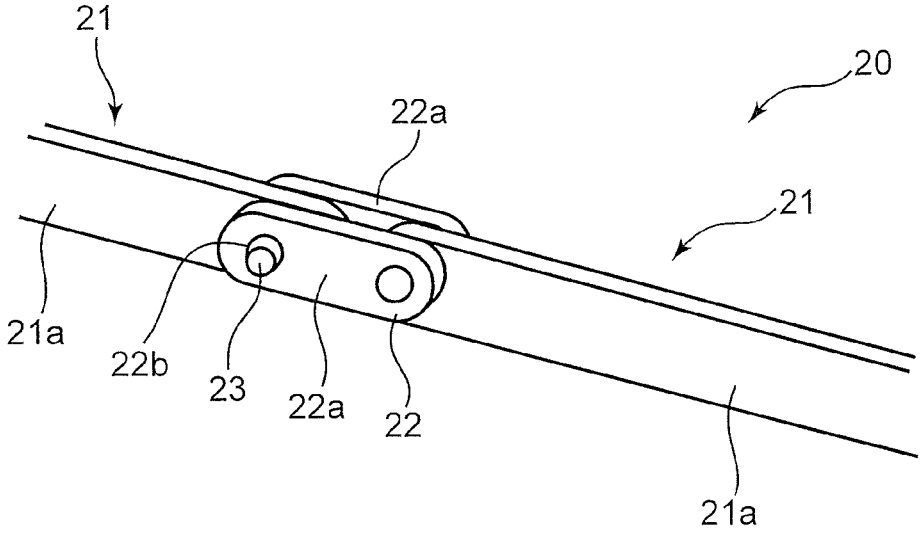
FIG. 7 is a perspective view illustrating, as enlarged, a joint portion between guy lines.

FIG. 7 is a schematic perspective view illustrating, as enlarged, a joint portion between the boom guy links 21. As illustrated in FIG. 7, the boom guy link 21 has a main body part 21*a* extending in a predetermined direction, and a boom-side link part 22 attached to one end of the main body part 21*a* in the longitudinal direction. The boom-side link part 22 includes a pair of boom-side link plates 22*a* and 22*a*. The boom-side link plates 22*a* and 22*a* are attached to the end of the main body part 21*a* with this end being held therebetween. Each boom-side link plate 22*a* extends from the end of the main body part 21*a* in the direction away therefrom. A through-hole 22*b* is formed at the tip of each boom-side link plate 22*a*.

An end of one of the boom guy links 21 is inserted between the boom-side link plates 22*a* and 22*a* of the adjacent boom guy link 21. A pin 23 (hereinafter referred to as a guy link connection pin 23 as appropriate) is inserted into a through-hole 21*b* (see FIG. 10) formed at the end of one of the boom guy links 21 and the through-holes 22*b* and 22*b* formed in the boom-side link plates 22*a* and 22*a* of the other boom guy link 21. Thus, the adjacent two boom guy links 21 are connected to each other.

(2-2) Structure of Guide Member

The detailed structure of the guide member 100 will be described.

The guide member 100 includes a pulley for guiding (this pulley corresponds to the lower restriction section and is hereinafter referred to as a guide pulley) 130, a support section 120 that supports the guide pulley 130 in a rotatable manner, and a pair of link sections 110 and 110 for connecting the support section 120 to the main guy lines 20. The guide pulley 130 is configured of rotary body.

The link sections 110 are individually attached respectively to a pair of main guy lines 20 and 20 arranged parallel to each other. The two link sections 110 and 110 are symmetrical (symmetrical in the horizontal direction in FIG. 10, that is, the two link sections 110 and 110 are symmetrical in the width direction of the boom 5 in a state where they are respectively attached to the main guy lines 20 and 20). Now, one of the link sections 110 will be described.

In the present embodiment, the link section 110 is attached to the boom-side link part 22 of the main guy line 20. The link section 110 has a pair of link plates 111 and 111 extending in the vertical direction. Through-holes 111*a* and 111*b* are respectively formed at the upper end and the lower end of each link plate 111. The two link plates 111 and 111 hold the boom-side link plates 22*a* and 22*a* of the boom guy link 21 from the outside. The guy link connection pin 23 is inserted into the through-holes 111*a* and 111*a* of the link plates 111. Thus, the link section 110 is attached to the boom-side link part 22, that is, the joint portion between the two boom guy links 21. In such a fixation state, the respective link plates 111 are pivotable about the center axis of the guy link connection pin 23.

The support section 120 has a pair of connection plates 121. The pair of connection plates 121 and 121 is connected to the link sections 110 and 110, respectively, whereby the support section 120 is coupled to the link sections 110. Each connection plate 121 is a plate-shaped member extending upward. The connection structures between the connection plates 121 and the link sections 110 are symmetrical (symmetrical in the horizontal direction in FIG. 10). Now, one of the connection structures between the connection plate 121 and the link section 110 will be described.

Pin receiving sections 121*a* and 121*a* respectively projecting from the front surface and the back surface of the connection plate 121 are provided on the upper part of the connection plate 121. The connection plate 121 is formed with a pin receiving hole 121*b* extending from the surface of one of the pin receiving sections 121*a* to the surface of the other pin receiving section 121*a* and penetrating through the connection plate 121. A pin 122 is inserted into the pin receiving hole 121*b* and the through-holes 111*b* and 111*b* formed at the lower parts of the link plates 111 and 111 of the link section 110. Thus, the connection plate 121 is connected to the link section 110.

Each connection plate 121 is connected to the corresponding link section 110 as described above, whereby the support section 120 and the guide pulley 130 supported by the support section 120 are attached to the main guy line 20.

The support section 120 has a supporting rod 123 extending between the two connection plates 121 and 121. A first support plate 124 and a second support plate 125 which extend downward from the supporting rod 123 are attached at almost the center of the supporting rod 123 in the longitudinal direction (horizontal direction in FIG. 10). The first support plate 124 and the second support plate 125 are arranged with a predetermined space therebetween in the longitudinal direction of the supporting rod 123. A columnar shaft 126 projecting toward the second support plate 125 is provided at the lower end of the first support plate 124. As described below, the supporting rod 123 can be in contact with the raising rope 33 from above in a state where the raising rope 33 is supported by the guide member 100. In this way, the supporting rod 123 functions as an upper contact member that can be in contact with the raising rope 33 from above.

The guide pulley 130 has a through-hole 130*a* formed at the central part of a disk-shaped member. The shaft 126 is inserted through the through-hole 130*a*. Due to the shaft 126, the guide pulley 130 is supported to be rotatable about the shaft 126. The guide pulley 130 is disposed between the first support plate 124 and the second support plate 125 in the longitudinal direction of the supporting rod 123. With the guide member 100 being attached to the main guy lines 20, the guide pulley 130 is disposed between a pair of main guy lines 20 and 20. As described below, the guide pulley 130 can be in contact with the raising rope 33 from below in a state where the raising rope 33 is supported by the guide member 100. In this way, the guide pulley 130 functions as a lower contact member that can be in contact with the raising rope 33 from below.

The support section 120 further includes a holding section 127 that is detachably attached to the second support plate 125 and the shaft 126. The holding section 127 is a plate-shaped member extending downward beyond the shaft 126 from the lower end of the second support plate 125. The second support plate 125 is provided with, at its lower end, a protrusion 125*a* protruding toward the side opposite to the first support plate 124 (protruding to the right in FIG. 10). Through-holes 127*a* and 127*b* that penetrate through the holding section 127 from the front surface to the back surface are formed at the upper end and the lower end of the holding section 127.

The protrusion 125*a* of the second support plate 125 and the shaft 126 are respectively fitted to the through-holes 127*a* and 127*b* of the holding section 127. Thus, the holding section 127 is coupled to the second support plate 125 and the shaft 126. A retaining pin 128 is inserted into a portion of the shaft 126, the portion protruding outward (to the right in FIG. 10) from the holding section 127. Thus, the outward movement of the holding section 127 is restricted. More specifically, a through-hole penetrating in the vertical direction is formed at the end of the shaft 126. The retaining pin 128 is inserted into this through-hole.

The holding section 127 is attached to the second support plate 125 and the shaft 126 as described above, whereby the guide pulley 130 is held by the first support plate 124 and the holding section 127 at a position between them.

In the present embodiment, the support section 120 is hoisted by a crane or the like while supporting the guide pulley 130, and carried to the position where the support section 120 is to be coupled to the main guy lines 20 and 20 (specifically, the position where the support section 120 is to be coupled to the link sections 110 and 110 attached to the main guy lines 20 and 20). To this end, a wire attaching section 129 to which a lifting wire is attached is provided to the supporting rod 123. A pair of wire attaching sections 129 and 129 respectively projecting upward is provided at symmetrical positions with respect to the center of the supporting rod 123 in the longitudinal direction.

(2-3) Procedure for Raising Raisable and Lowerable Member

Next, a procedure for raising the rear strut 13 according to the second embodiment will be described. In the following description, the vertical direction in FIG. 2 is also merely referred to as a vertical direction.

(Preparatory Step)

Figure 11:
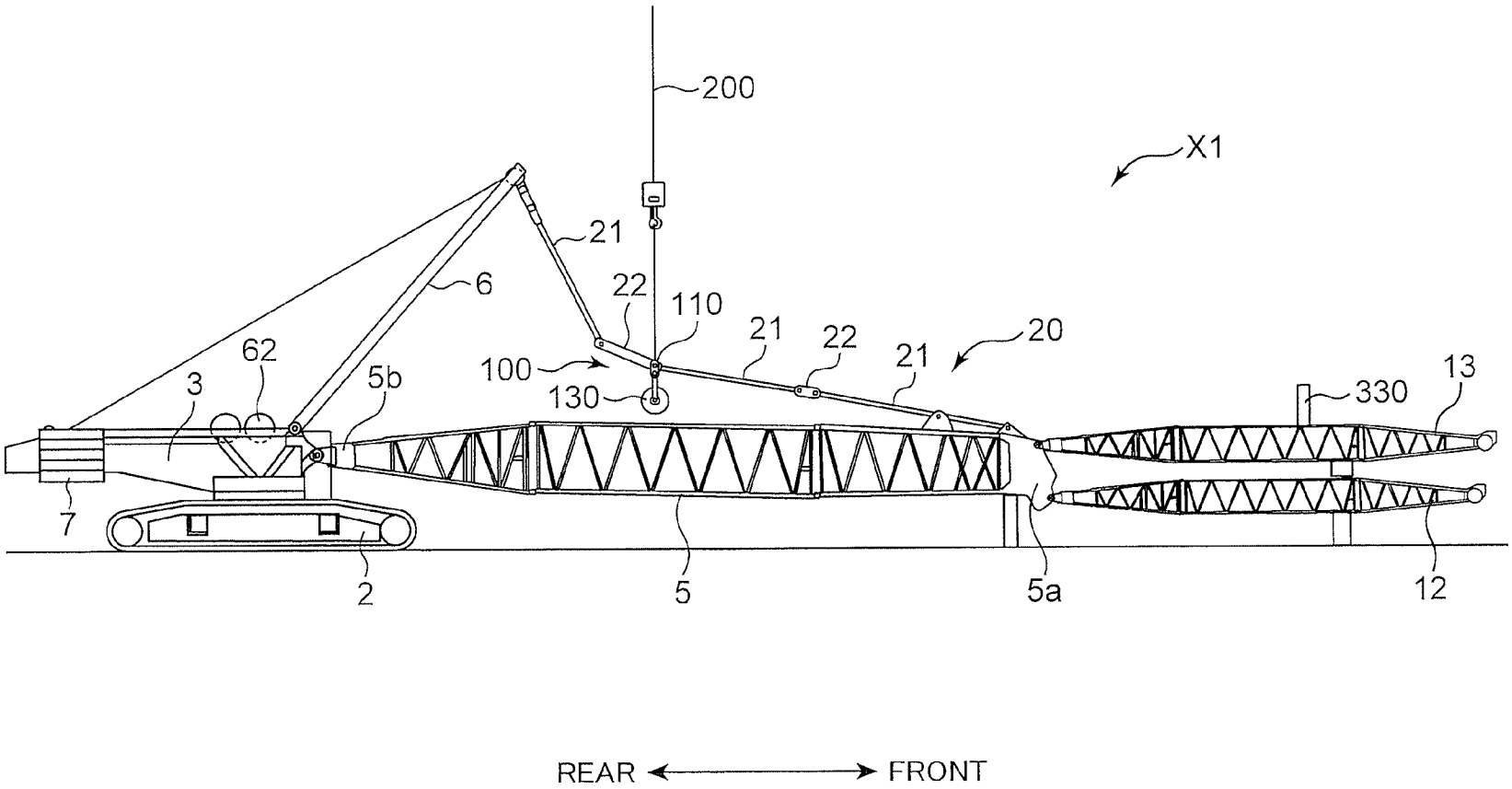
FIG. 11 is a side view of a crane, according to a second embodiment, when the guide member is attached to a main guy line.

As in the first embodiment, first, the crane X1 is brought into the state (the state illustrated in FIG. 2) where the boom 5 and the strut unit 10 are laid down on the installation surface, such as a ground, so as to extend along the installation surface with the boom 5 extending forward of the machine body 1 and the strut unit 10 extending forward of the boom 5. On the other hand, in the second embodiment, the mast 6 is raised at the rear of the boom 5 with respect to the machine body 1 such that the main guy line 20 obliquely extends forward and downward toward the distal end 5*a* of the boom 5 from the tip (upper end) of the mast 6 (support member raising step), as illustrated in FIG. 11. It is to be noted that, in the first embodiment, the process for raising the mast 6 may be performed in the preparatory step.

In the present embodiment, to facilitate the mounting of the guide member 100 to the main guy line 20, the raised amount of the mast 6 is set to be smaller than the maximum amount (the amount by which the main guy line 20 extends upright) such that the main guy line 20 bends at the joint portion between the boom guy links 21 as illustrated in FIG. 11. That is, the part, which is located at the distal end of the boom 5, of the main guy line 20 is located below a position when the raising amount of the mast 6 is the maximum.

Then, the guide member 100 is attached to the main guy line 20. The position where the guide member 100 is attached is not particularly limited. In the present embodiment, the guide member 100 is attached such that a force is applied to the rear strut 13 from the raising rope 33 at a position distant from the pivot center of the rear strut 13 in the later-described raising step. That is, the guide member 100 is attached such that the raising rope 33 pulls the rear strut 13 at a higher position to enable efficient raising of the rear strut 13. Specifically, the guide member 100 is attached at the joint portion between the boom guy links 21, the joint portion being at a position on the rear from the center of the main guy line 20 in the front-rear direction.

More specifically, a pair of link sections 110 of the guide member 100 is first attached to the main guy lines 20. As described above, the link plates 111 of the guide member 100 are attached to the boom-side link part 22 by inserting the guy link connection pin 23 into the through-holes 111*a* at the upper ends of the link plates 111. Thus, the link section 110 is attached to the boom-side link part 22, that is, the joint portion between the boom guy links 21.

Thereafter, the support section 120 supporting the guide pulley 130 is hoisted by another crane 200 and disposed near the link sections 110. More specifically, a wire is attached to the wire attaching sections 129 of the support section 120. The wire is then hoisted by the crane 200, and the support section 120 and the guide pulley 130 are carried between the link sections 110.

Next, the support section 120 is attached to the link sections 110. Specifically, the support section 120 and the link sections 110 are connected by inserting the pins 122 into the pin receiving holes 121*b* in the connection plates 121 of the support section 120 and the through-holes 111*b* of the link plates 111.

After the support section 120 and the link sections 110 are connected, the crane 200 and the support section 120 are decoupled, and the guide member 100 is hung from the main guy line 20.

(Rope Routing Step)

Next, the raising rope 33 is coupled to the rear strut 13. In the second embodiment as well, the raising rope 33 is coupled to the rear strut 13 through the raising bar 330. On the other hand, in the second embodiment, the raising rope 33 is routed to pass between the supporting rod 123 and the guide pulley 130.

Figure 12:
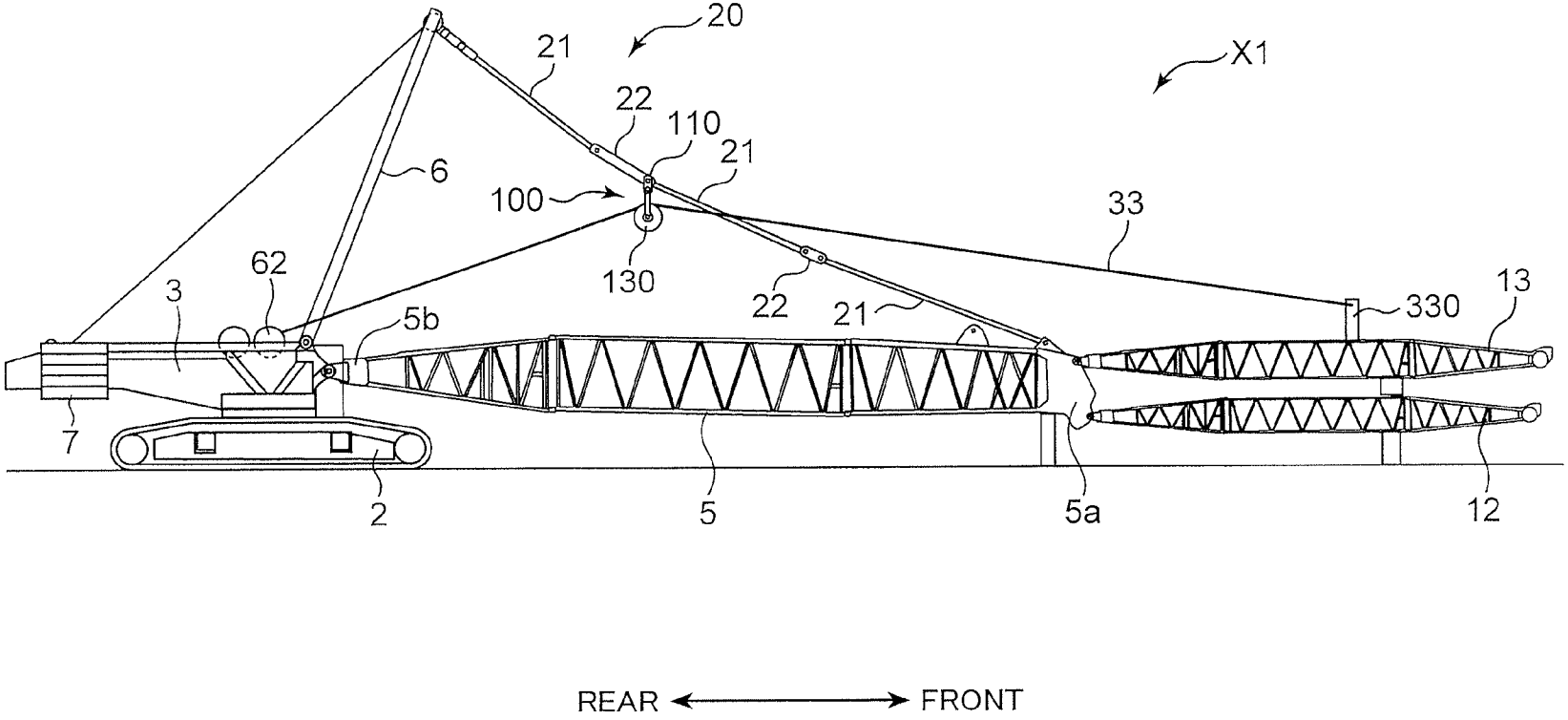
FIG. 12 is a side view of the crane according to the second embodiment after a rope routing step is ended.

Specifically, the raising rope 33 wound around the main winch 62 is pulled forward from the main winch 62. Then, as illustrated in FIG. 12, the raising rope 33 is pulled to the raising bar 330 while passing between the supporting rod 123 and the guide pulley 130 of the guide member 100. Then, the end of the raising rope 33 is coupled to the upper end of the raising bar 330. Thus, the raising rope 33 is routed to extend to the main winch 62 from the upper end of the raising bar 330 through between the supporting rod 123 and the guide pulley 130 of the guide member 100. In this state, the raising rope 33 is placed on the outer peripheral surface of the guide pulley 130 and supported by this outer peripheral surface. In addition, the supporting rod 123 is disposed at a position where the supporting rod 123 can be in contact with the raising rope 33 from above.

In the present embodiment, as described above, the raising rope 33 is routed with the raised amount of the mast 6 being set to be smaller than the maximum amount (the amount by which the main guy line 20 extends upright), that is, with the guide member 100 being at a lower position, such that the main guy line 20 bends at the joint portion between the boom guy links 21 as illustrated in FIG. 11. Therefore, the raising rope 33 can easily be routed. After the routing of the raising rope 33 is finished, the mast 6 is raised upward as illustrated in FIG. 12. Thus, the guide member 100 and the portion, which is supported by the guide member 100, of the raising rope 33 move upward.

(Raising Step)

Figure 13:
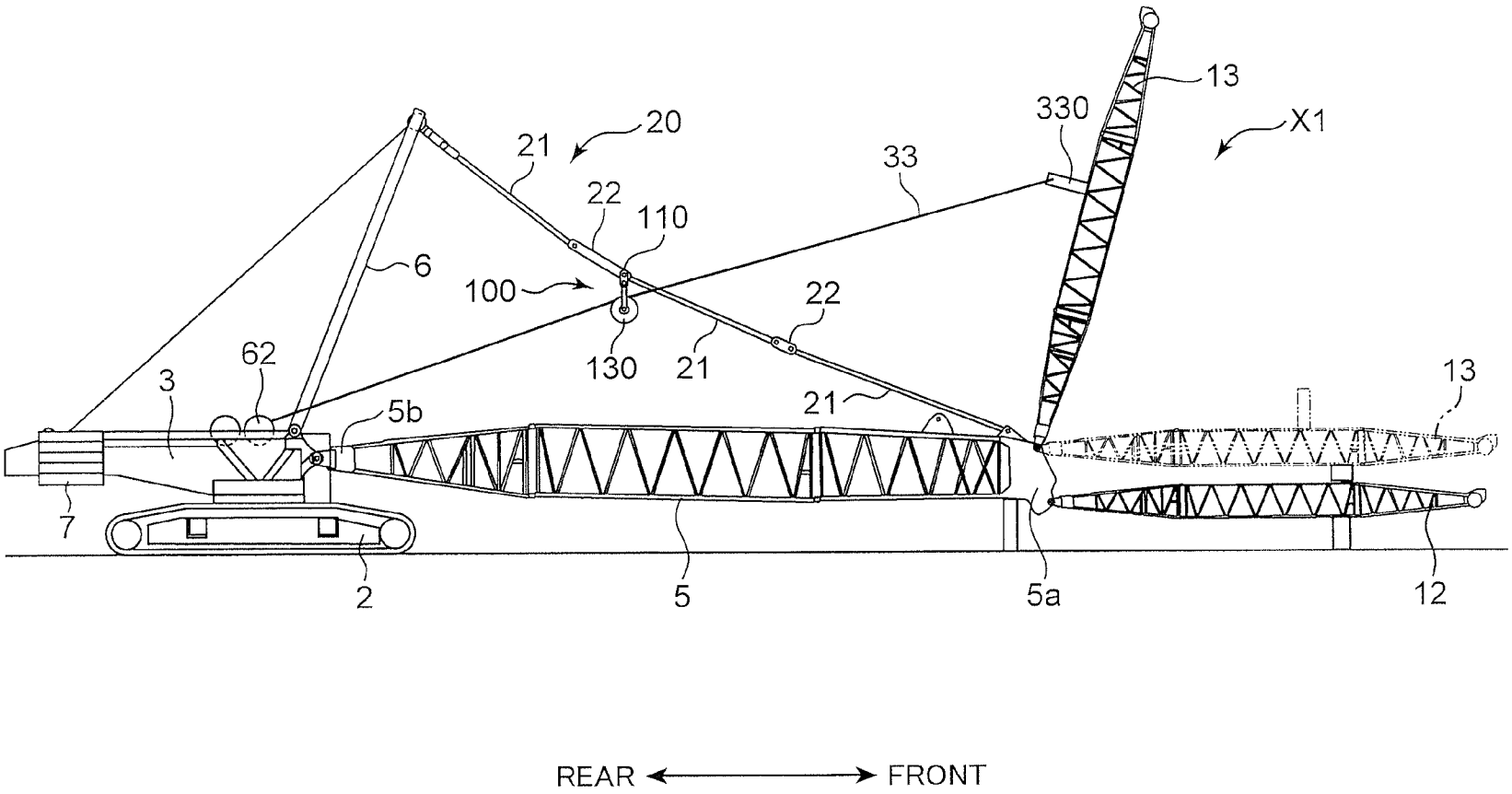
FIG. 13 is a side view of the crane, according to the second embodiment, to which a raising step is currently executed.

Next, as in the first embodiment, the raising rope 33 is wound up by the main winch 62. Thus, the rear strut 13 is raised with respect to the boom 5 from the state indicated by a broken line to the state indicated by a solid line in FIG. 13.

It should be noted here that, in the second embodiment, the raising rope 33 moves rearward through between the supporting rod 123 and the guide pulley 130 of the guide member 100 while rotating the guide pulley 130.

(Guide Member Removing Step)

After the process for raising the rear strut 13 is finished, the guide member 100 is removed from the main guy line 20. Specifically, the guide member 100 is removed from the main guy line 20 in the procedure reverse to the procedure for mounting the guide member 100 to the main guy line 20.

(2-4) Operation and Others

As described above, in the second embodiment as well, the rear strut 13 is raised by winding up the raising rope 33 coupled to the rear strut 13. Therefore, as in the first embodiment, the rear strut 13 can be raised in less space at low cost.

Moreover, in the second embodiment, the raising rope 33 is also wound up while being supported at a position above and distant from the upper surface of the boom 5 by the guide member 100. Therefore, an interference between the raising rope 33 and the upper surface of the boom 5 or the like can be prevented, whereby damage to the raising rope 33 can be suppressed.

Further, in the second embodiment as well, the raising rope 33 moves through between the supporting rod 123 and the guide pulley 130 of the guide member 100. Therefore, the vertical movement of the raising rope 33 can be restricted by the supporting rod 123 and the guide pulley 130. Accordingly, the interference between the raising rope 33 and the other members caused by the vertical swing of the raising rope can also be suppressed, whereby damage to the raising rope 33 can more reliably be suppressed.

In particular, in the second embodiment, the guide member 100 is attached to the main guy line 20 obliquely extending forward and downward toward the distal end 5*a* of the boom 5 from the tip of the mast 6. Therefore, the distance from the upper surface of the boom 5 to the guide member 100 and the raising rope 33 supported by the guide member 100 can be increased with the vertical size of the guide member 100 being reduced. Accordingly, works for carrying and attaching the guide member 100 are facilitated, while the interference between the raising rope 33 and the upper surface of the boom 5 or the like can effectively be prevented.

Further, in the second embodiment, the guide pulley 130 is also a pulley, and the raising rope 33 also moves while rotating the guide pulley 130. Therefore, the raising rope 33 can smoothly be moved.

In addition, in the second embodiment as well, the raising rope 33 is connected to the raising bar 330 projecting upward from the upper surface of the rear strut 13, as in the first embodiment. Therefore, the rear strut 13 can efficiently be raised by applying a high rotation moment thereto.

(3) Modifications

Each of the above embodiments describes the case where the rear strut 13 is raised with respect to the boom 5. However, the configuration and method according to each of the above embodiments are also applicable to raise other members (for example, the front strut 12 and the jib) with respect to the boom 5.

The first embodiment describes the case where the upper sheave 310 and the lower sheave 320 are disposed such that the raising rope 33 is in contact with the outer peripheral surfaces of these sheaves. However, these sheaves 310 and 320 may be disposed to be capable of being in contact with the raising rope 33 from above and from below.

The first embodiment describes the case where the upper sheave 310 and the lower sheave 320, which are pulleys, are used as members contactable with the raising rope 33 from above and from below. However, members having other structures may be used as a member which is contactable with the raising rope 33 from above and from below. For example, in place of the pulley, a structure provided with a plurality of rotary members rotating about an axis extending in the width direction of the boom 5 may be used. Alternatively, a non-rotatable member may be used. However, if a member rotating about an axis extending in the width direction of the boom 5 is used as a member contactable with the raising rope 33 from above and from below, the raising rope 33 can smoothly be moved in the front-rear direction.

Similarly, in the second embodiment, a member provided with a plurality of rotary members or a non-rotatable member may also be used in place of the guide pulley 130.

Further, in the second embodiment, the member for restricting the upward movement of the raising rope 33 is not limited to the supporting rod 123 of the guide member 100. For example, it is appreciated to provide a member which is located above the raising rope 33 and contactable with the raising rope 33 above the guide pulley 130.

The above embodiments describe the case where the guide member 100 is attached to the boom-side link part 22. However, the method and structure for attaching the guide member 100 to the main guy line 20 arc not limited thereto. For example, the guide member 100 may be directly attached to the main body part 21*a* of the boom guy link 21 by using a clamp or the like. However, the guide member 100 can easily be attached to the main guy line 20 according to the above-mentioned structure and procedure of using the guy link connection pin 23 provided to the boom-side link part 22 for connecting the guy links 21 and inserting this pin 23 into the through-holes 111*a* of the link plates 111.

In addition, the guide member 100 may be attached to the main guy line 20 in a non-detachable manner. Accordingly, the step of removing the guide member 100 from the main guy line 20 may be skipped. However, the above-mentioned configuration in which the guide member 100 is removed can avoid a situation where efficiency is deteriorated due to the weight of the crane X1 being increased by the guide member 100 during a work not requiring the guide member 100 such as a work for suspending a load by the crane X1.

While the above embodiments describe the case where the raising rope 33 is coupled to the raising bar 330 projecting upward from the upper surface of the rear strut 13, the raising rope 33 may be directly coupled to the rear strut 13. However, the configuration of using the raising bar 330 enables efficient raising of the rear strut 13 by applying a high rotation moment to the rear strut 13.

The above embodiments describe the case where the crane X1 has the front strut 12 and the rear strut 13 as a strut. However, the crane X1 may have only one strut or may not have the strut unit 10.

The present invention provides a method for raising a raisable and lowerable member of a crane equipped with a machine body, a boom mounted to the machine body in a raisable and lowerable manner, and the raisable and lowerable member raisable and lowerable with respect to the boom, the method comprising: a rope routing step of coupling a raising rope to the raisable and lowerable member, in a state where the raisable and lowerable member and the boom are laid down along an installation surface on which the crane is placed with the boom extending forward of the machine body in a front-rear direction of the boom and with the raisable and lowerable member extending forward of the boom in the front-rear direction of the boom, and routing the raising rope to let the raising rope extend rearward of the raisable and lowerable member in the front-rear direction of the boom; and a raising step of winding up the raising rope rearward in the front-rear direction of the boom to raise the raisable and lowerable member with respect to the boom, the raising step being executed after the rope routing step, wherein in the rope routing step, the raising rope is routed to pass between an upper restriction section and a lower restriction section of a rope support member attached to the boom, the lower restriction section being disposed at a position closer to the boom than the raising rope to support the raising rope at a position above an upper surface of the boom while allowing a movement of the raising rope in the front-rear direction of the boom, the upper restriction section being disposed at a position farther away from the boom than the raising rope to be contactable with the raising rope, and in the raising step, the raising rope is wound up rearward in the front-rear direction of the boom while the upper restriction section restricts an upward movement of the raising rope and the lower restriction section restricts a downward movement of the raising rope.

According to this method, the raisable and lowerable member is raised by winding up the raising rope coupled to the raisable and lowerable member. Therefore, it is unnecessary to prepare a crane or the like for raising the raisable and lowerable member as compared to a configuration for raising the raisable and lowerable member by hoisting the raisable and lowerable member. Accordingly, this configuration provides a cost advantage.

Moreover, according to this method, the raising rope is wound up while being supported at a position above from the upper surface of the boom by the rope support member. Therefore, an interference between the raising rope and the upper surface of the boom and various members mounted on the upper surface can be prevented. In addition, according to this method, a vertical movement of the raising rope is restricted by the upper restriction section and the lower restriction section of the rope support member. Accordingly, a vertical swing of the raising rope during the winding up of the raising rope can be reduced, whereby the interference between the raising rope and the other members caused by the vertical swing can also be suppressed. Thus, damage to the raising rope can more reliably be suppressed.

The present invention also provides a method for raising a raisable and lowerable member of a crane equipped with a machine body, a boom mounted to the machine body in a raisable and lowerable manner, the raisable and lowerable member raisable and lowerable with respect to the boom, a support member that supports the boom and is raisable and lowerable with respect to the machine body, and a connection member for connecting a distal end of the boom and a distal end of the support member, the method comprising: a support member raising step of raising the support member with respect to the machine body rearward of the boom in the front-rear direction of the boom, in a state where the raisable and lowerable member and the boom are laid down along an installation surface on which the crane is placed with the raisable and lowerable member extending forward of the boom in a front-rear direction of the boom, such that the connection member obliquely extends forward and downward from the distal end of the support member toward the distal end of the boom; a rope routing step of coupling a raising rope to the raisable and lowerable member and routing the raising rope to extend rearward of the raisable and lowerable member in the front-rear direction of the boom; and a raising step of winding up the raising rope rearward in the front-rear direction of the boom to raise the raisable and lowerable member with respect to the boom, the raising step being executed after the support member raising step and the rope routing step, wherein in the rope routing step, the raising rope is routed to pass between an upper restriction section and a lower restriction section of a rope support member attached to the connection member, the lower restriction section being disposed at a position closer to the boom than the raising rope to support the raising rope at a position above an upper surface of the boom while allowing a movement of the raising rope in the front-rear direction of the boom, the upper restriction section being disposed at a position farther away from the boom than the raising rope to be contactable with the raising rope, and in the raising step, the raising rope is wound up rearward in the front-rear direction of the boom with an upward movement of the raising rope restricted by the upper restriction section and a downward movement of the raising rope restricted by the lower restriction section.

According to this method, the raisable and lowerable member is also raised by winding up the raising rope coupled to the raisable and lowerable member, whereby it is unnecessary to prepare a crane or the like for hoisting the raisable and lowerable member. Accordingly, this configuration provides a cost advantage. Moreover, the raising rope is wound up while being supported at a position above from the upper surface of the boom by the rope support member. Therefore, an interference between the raising rope and the upper surface of the boom and the like can be prevented. In addition, a vertical movement of the raising rope is restricted by the upper restriction section and the lower restriction section of the rope support member. Accordingly, the interference between the raising rope and the other members caused by the vertical swing of the raising rope can also be suppressed. Thus, damage to the raising rope can more reliably be suppressed.

Moreover, according to this method, the rope support member is attached to the connection member obliquely extending forward and downward from the distal end of the support member toward the distal end of the raisable and lowerable member. Therefore, the distance from the upper surface of the boom to the rope support member and the raising rope supported by the rope support member can be increased with the vertical size of the rope support member being reduced. Accordingly, works for attaching and carrying the rope support member arc facilitated, while the interference between the raising rope and the upper surface of the boom and the like can effectively be prevented.

It is preferable that, in the above method, the lower restriction section includes a rotary body rotatable about an axis orthogonal to the front-rear direction of the boom and extending along the installation surface, and in the raising step, the raising rope is wound up rearward in the front-rear direction of the boom, while the rotary body supports the raising rope on an outer peripheral surface of the rotary body and rotates with the rearward movement of the raising rope.

According to this configuration, the raising rope can be wound up with an interference between the raising rope and the upper surface of the boom and the like being suppressed.

The present invention also provides a crane comprising: a machine body; a boom mounted to the machine body in a raisable and lowerable manner; a raisable and lowerable member mounted in a raisable and lowerable manner with respect to the boom; and a rope support member that is attached to the boom to support a raising rope coupled to the raisable and lowerable member, wherein the rope support member includes a lower restriction section and an upper restriction section, the lower restriction section being disposed at a position closer to the boom than the raising rope to support the raising rope at a position above an upper surface of the boom while allowing a movement of the raising rope in a front-rear direction of the boom in a preparatory state where the raisable and lowerable member and the boom are laid down along an installation surface on which the crane is placed with the boom extending forward of the machine body in the front-rear direction of the boom and with the raisable and lowerable member extending forward of the boom in the front-rear direction of the boom, the upper restriction section being disposed at a position farther away from the boom than the raising rope to be contactable with the raising rope in the preparatory state.

According to the crane described above, when the raising rope routed to extend rearward from the raisable and lowerable member in the preparatory state is moved in the front-rear direction, the raising rope can be supported at a position above the upper surface of the boom by the rope support member. Therefore, an interference between the raising rope and the upper surface of the boom and the like can be prevented. In addition, a vertical movement of the raising rope is restricted by the upper restriction section and the lower restriction section of the rope support member. Accordingly, a vertical swing of the raising rope during the movement of the raising rope can be reduced, whereby the interference between the raising rope and the other members caused by the vertical swing can also be suppressed. Thus, damage to the raising rope can more reliably be suppressed.

It is preferable that, in the above configuration, the lower restriction section rotates about an axis orthogonal to the front-rear direction of the boom and extending along the installation surface, along with a movement of the raising rope in the front-rear direction of the boom, to allow the movement of the raising rope in the front-rear direction of the boom.

According to this configuration, the rope coupled to the raisable and lowerable member and supported by the rope support member can smoothly be moved in the front-rear direction.

This application is based on Japanese Patent application No. 2017-067692 filed in Japan Patent Office on Mar. 30, 2017, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A method for raising a raisable and lowerable member of a crane equipped with a machine body, a boom mounted to the machine body in a raisable and lowerable manner, and the raisable and lowerable member being raisable and lowerable with respect to the boom, the method comprising:

a rope routing step of coupling a raising rope to the raisable and lowerable member, in a state where the raisable and lowerable member and the boom are laid down along an installation surface on which the crane is placed, the boom extending forward of the machine body in a front-rear direction of the boom, and the raisable and lowerable member extending forward of the boom in the front-rear direction of the boom, and routing the raising rope to let the raising rope extend rearward of the raisable and lowerable member in the front-rear direction of the boom; and a raising step of winding up the raising rope rearward in the front-rear direction of the boom to raise the raisable and lowerable member with respect to the boom, the raising step being executed after the rope routing step, wherein in the rope routing step, the raising rope is routed to pass between an upper restriction section and a lower restriction section of a rope support member attached to the boom, the lower restriction section being disposed at a position closer to the boom than the raising rope to support the raising rope at a position above an upper surface of the boom while allowing a movement of the raising rope in the front-rear direction of the boom, the upper restriction section being disposed at a position farther away from the boom than the raising rope to be contactable with the raising rope, and in the raising step, the raising rope is wound up rearward in the front-rear direction of the boom, while the upper restriction section restricts an upward movement of the raising rope and the lower restriction section restricts a downward movement of the raising rope.

2. A method for raising a raisable and lowerable member of a crane equipped with a machine body, a boom mounted to the machine body in a raisable and lowerable manner, the raisable and lowerable member being raisable and lowerable with respect to the boom, a support member that supports the boom and is raisable and lowerable with respect to the machine body, and a connection member for connecting a distal end of the boom and a distal end of the support member, the method comprising:

a support member raising step of raising the support member with respect to the machine body rearward of the boom in the front-rear direction of the boom, in a state where the raisable and lowerable member and the boom are laid down along an installation surface on which the crane is placed, the raisable and lowerable member extending forward of the boom in a front-rear direction of the boom, such that the connection member obliquely extends forward and downward from the distal end of the support member toward the distal end of the boom;

a rope routing step of coupling a raising rope to the raisable and lowerable member, and routing the raising rope to extend rearward of the raisable and lowerable member in the front-rear direction of the boom; and a raising step of winding up the raising rope rearward in the front-rear direction of the boom to raise the raisable and lowerable member with respect to the boom, the raising step being executed after the support member raising step and the rope routing step, wherein in the rope routing step, the raising rope is routed to pass between an upper restriction section and a lower restriction section of a rope support member attached to the boom, the lower restriction section being disposed at a position closer to the boom than the raising rope to support the raising rope at a position above an upper surface of the boom while allowing a movement of the raising rope in the front-rear direction of the boom, the upper restriction section being disposed at a position farther away from the boom than the raising rope to be contactable with the raising rope, and in the raising step, the raising rope is wound up rearward in the front-rear direction of the boom, an upward movement of the raising rope being restricted by the upper restriction section, a downward movement of the raising rope being restricted by the lower restriction section.

3. The method for raising a raisable and lowerable member according to claim 1, wherein the lower restriction section includes a rotary body rotatable about an axis orthogonal to the front-rear direction of the boom and extending along the installation surface, and in the raising step, the raising rope is wound up rearward in the front-rear direction of the boom, while the rotary body supports the raising rope on an outer peripheral surface of the rotary body and rotates with the rearward movement of the raising rope.

4. The method for raising a raisable and lowerable member according to claim 2, wherein the lower restriction section includes a rotary body rotatable about an axis orthogonal to the front-rear direction of the boom and extending along the installation surface, and in the raising step, the raising rope is wound up rearward in the front-rear direction of the boom, while the rotary body supports the raising rope on an outer peripheral surface of the rotary body and rotates with the rearward movement of the raising rope.

* * * * *